US008181956B2

(12) United States Patent
Shiba

(10) Patent No.: US 8,181,956 B2
(45) Date of Patent: May 22, 2012

(54) SHEET TRANSPORT DEVICE FOR IMAGE FORMING APPARATUS

(75) Inventor: Tetsuo Shiba, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/042,439

(22) Filed: Mar. 7, 2011

(65) Prior Publication Data

US 2011/0262200 A1 Oct. 27, 2011

Related U.S. Application Data

(60) Provisional application No. 61/326,541, filed on Apr. 21, 2010.

(51) Int. Cl.

| | |
|---|---|
| ***B65H 9/00*** | (2006.01) |
| ***B65H 5/02*** | (2006.01) |
| ***B65H 5/04*** | (2006.01) |

(52) U.S. Cl. ..... 271/226; 271/242; 271/272

(58) Field of Classification Search ..... 271/226, 271/242, 272

See application file for complete search history.

(56) References Cited

U.S. PATENT DOCUMENTS

| | | | | |
|---|---|---|---|---|
| 6,896,257 | B2 * | 5/2005 | Yamashita et al. | 271/242 |
| 2003/0146566 | A1 * | 8/2003 | Aizawa | 271/242 |
| 2006/0284369 | A1 * | 12/2006 | Park | 271/242 |

* cited by examiner

*Primary Examiner* — David H Bollinger

(74) *Attorney, Agent, or Firm* — Patterson & Sheridan, LLP

(57) ABSTRACT

A sheet transport device includes: a registration roller pair that includes a first roller and a second roller lower in abrasion resistance than the first roller, and nips and transports a recording medium; and a drive mechanism that provides a rotation to the first roller to rotate at the first circumferential speed, and provides a rotation to the second roller to rotate at the second circumferential speed different from the first circumferential speed.

19 Claims, 3 Drawing Sheets

SHEET TRANSPORT DEVICE FOR IMAGE FORMING APPARATUS

CROSS REFERENCE TO RELATED APPLICATION

This application is based upon and claims the benefit of priority from Provisional U.S. Application 61/326,541 filed on Apr. 21, 2010, the entire contents of which are incorporated herein by reference.

FIELD

Embodiments described herein relate to a sheet transport device that transports a sheet to a transfer position in synchronism with driving of an image carrier in an image forming apparatus such as a copying machine, a printer or the like.

BACKGROUND

In an image forming apparatus such as a copying machine, a printer or the like, a sheet is nipped and transported to a transfer position after a front end position of the sheet transported from a sheet feeder is aligned by a registration roller pair. In the registration roller pair, there is a device that rotates both rollers that nip the sheet therebetween at the same circumferential speed for the purpose of preventing the sheet from slanting to prevent a positional displacement of a transfer image on the sheet.

However, if outer diameters of the rollers are varied due to abrasion while the registration roller pair rotates, there is a risk that slanting or transport delay of the sheet occurs due to a difference in the circumferential speed between both the rollers, and a trouble of an image caused by transfer displacement occurs.

For that reason, the development of the registration rollers that are maintained at the same circumferential speed even if the rollers are abraded is desired.

DETAILED DESCRIPTION

According to an embodiment, a sheet transport device includes: a registration roller pair that includes a first roller and a second roller lower in abrasion resistance than the first roller, and nips and transports a recording medium; and a drive mechanism that provides a rotation to the first roller to rotate at the first circumferential speed, and provides a rotation to the second roller to rotate at the second circumferential speed different from the first circumferential speed.

Hereinafter, embodiments will be described.

First Embodiment

Figure 1:
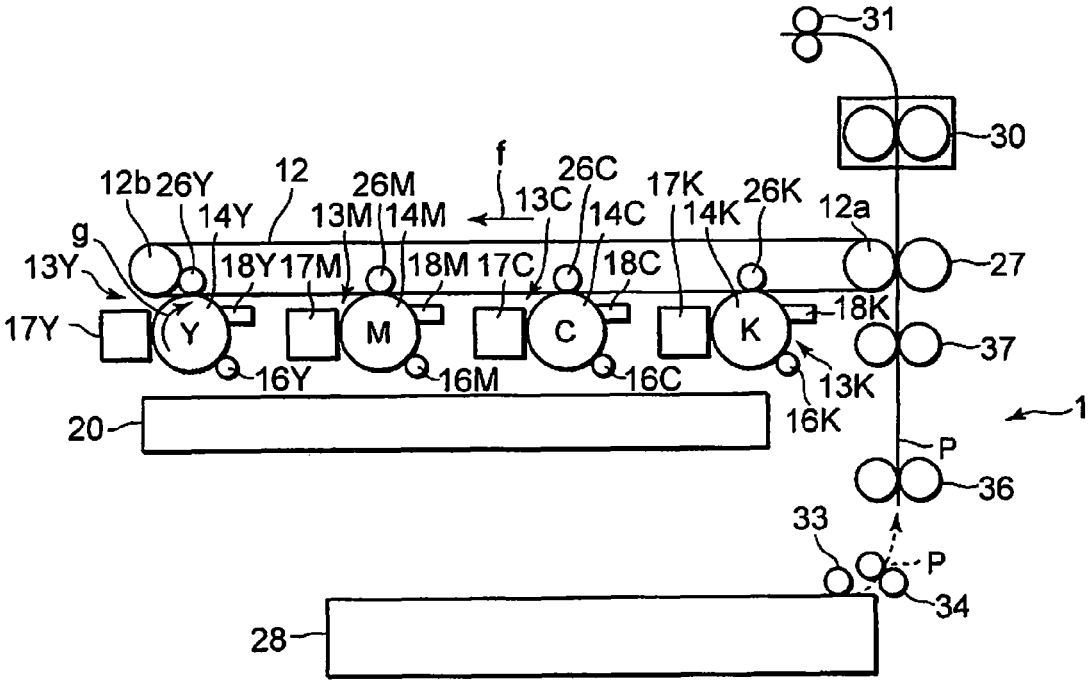
FIG. 1 is a schematic configuration diagram illustrating a main portion of a color printer according to a first embodiment.

FIG. 1 illustrates a main portion of a 4-drum tandem color printer 1 that is an image forming apparatus according to a first embodiment. The color printer 1 includes four sets of image forming stations 13Y, 13M, 13C, and 13K, which configure image formation units arranged in parallel along a lower side of a transfer belt 12 which is an image carrier, and form toner images on the transfer belt 12. The image forming stations 13Y, 13M, 13C, and 13K include photoconductive drums 14Y, 14M, 14C, and 14K, respectively. The image forming stations 13Y, 13M, 13C, and 13K form toner images of Y (yellow), M (magenta), C (cyan), and K (black) on the photoconductive drums 14Y, 14M, 14C, and 14K, respectively.

The image forming stations 13Y, 13M, 13C, and 13K include chargers 16Y, 16M, 16C, and 16K, developing devices 17Y, 17M, 17C, and 17K, and photoconductive cleaners 18Y, 18M, 18C, and 18K around the photoconductive drums 14Y, 14M, 14C, and 14K, respectively.

The color printer 1 includes a laser exposure device 20 that configures the image formation unit. The laser exposure device 20 irradiates the photoconductive drums 14Y, 14M, 14C, and 14K between the chargers 16Y, 16M, 16C, and 16K and the developing devices 17Y, 17M, 17C, and 17K with laser beams corresponding to the respective colors to form electrostatic latent images on the photoconductive drums 14Y, 14M, 14C, and 14K, respectively. The developing devices 17Y, 17M, 17C, and 17K develop the electrostatic latent images formed on the photoconductive drums 14Y, 14M, 14C, and 14K, respectively, to form toner images of Y (yellow), M (magenta), C (cyan), and K (black) on the photoconductive drums 14Y, 14M, 14C, and 14K, respectively.

The color printer 1 includes a backup roller 12*a* and a driven roller 12*b* between which the transfer belt 12 extends, and allows the transfer belt 12 to travel in a direction of an arrow f. The color printer 1 includes primary transfer rollers 26Y, 26M, 26C, and 26K at positions facing the photoconductive drums 14Y, 14M, 14C, and 14K through the transfer belt 12, respectively. The primary transfer rollers 26Y, 26M, 26C, and 26K primarily transfer the toner images on the photoreceptor drums 14Y, 14M, 14C and 14K to the transfer belt 12 superimpose on top of another. The photoconductive cleaners 18Y, 18M, 18C, and 18K remove toner remaining on the photoconductive drums 14Y, 14M, 14C, and 14K after primary transfer, respectively, and recover the removed toner.

The color printer 1 includes a secondary transfer roller 27 at a secondary transfer position facing the backup roller 12*a* through the transfer belt 12. The color printer 1 includes a paper cassette 28 that accommodates sheets P that are recording media therein. The color printer 1 includes a pickup roller 33, a separation roller pair 34, a transport roller pair 36, and a registration roller pair 37 between the paper cassette 28 and the secondary transfer roller 27.

The color printer 1 separates the sheets P extracted from the paper cassette 28 into one sheet P by the separation roller pair 34, and transports the sheet P to the registration roller pair 37 by the transport roller pair 36. The color printer 1 stops the registration roller pair 37 once, and abuts a front end of the sheet P against the registration roller pair 37 to align the front end of the sheet P. After aligning the front end of the sheet P, the color printer 1 drives the registration roller pair 37, and transports the sheet P to the secondary transfer roller 27.

The color printer 1 secondarily transfers the toner images formed on the transfer belt 12 to the sheet P transported from the registration roller pair 37 at a nip between the transfer belt 12 and the secondary transfer roller 27 in a lump. The color printer 1 includes a fixing device 30 and a sheet discharge roller pair 31 downstream of the secondary transfer roller 27 along a transport direction of the sheet P. The color printer 1 fixes the toner image on the sheet P through the fixing device 30, and discharges the sheet P through the sheet discharge roller pair 31.

Figure 2:
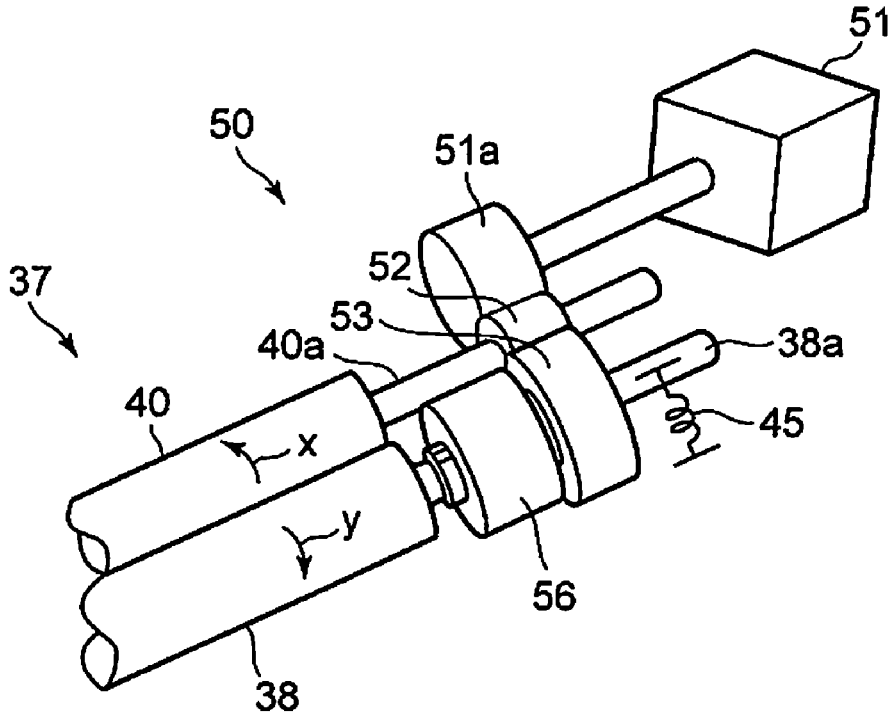
FIG. 2 is a schematic perspective view illustrating a driving side end of a registration roller pair according to the first embodiment.
Figure 3:
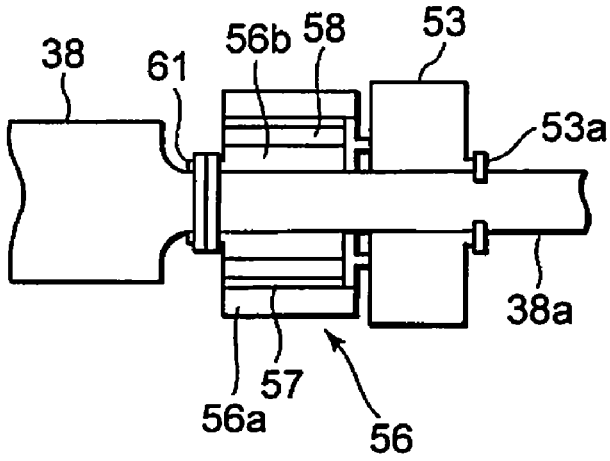
FIG. 3 is a schematic explanatory view illustrating a connection of the registration roller pair with a torque limiter according to the first embodiment.

The registration roller pair 37 will be described in detail. As illustrated in FIG. 2, the registration roller pair 37 includes a driving roller 40 that is a first roller, and a driven roller 38 that is a second roller. The registration roller pair 37 includes a pressure member 45 such as a spring, which brings the driven roller 38 in pressure contact with the driving roller 40. The driving roller 40 is formed of a metal roller made of Steel Use Stainless (SUS), and the driven roller 38 is formed of a rubber roller made of, for example, ethylene-propylene rubber (EPDM) lower in abrasion resistance than the driving roller 40.

The color printer 1 includes a drive mechanism 50 that drives the registration roller pair 37. The drive mechanism 50 includes a motor 51 that is a drive source that drives the driving roller 40, a motor gear 51*a*, a first gear 52 engaged with the motor gear 51*a*, and a second gear 53 engaged with the first gear 52. The drive mechanism 50 has a mechanism that rotates the driven roller 38 lower in the abrasion resistance than the driving roller 40 at a second circumferential speed higher than a first circumferential speed when rotating the driving roller 40 at the first circumferential speed.

A principle for setting the rotation of the driving roller 40 and the rotation of the driven roller 38 by the drive mechanism 50 will be described. When an endurance test of the registration roller pair is conducted using a registration roller pair comprising, for example, a metal roller and a rubber roller, the rubber roller is abraded as compared with the metal roller. For example, it is assumed that when sheets of about 800×1000 pass through the registration roller pair, an outer diameter of the rubber roller is reduced by about 1%. When the rubber roller rotates at the same circumferential speed as that of the metal roller, if the outer roller of the rubber roller is reduced by about 1%, the circumferential speed of the rubber roller is reduced by about 1% as compared with a case (initial time) in which the rubber roller is not abraded. That is, a difference in the circumferential speed occurs between the metal roller and the rubber roller.

Accordingly, the drive mechanism 50 sets the rotation (circumferential speed) of the rubber roller to be higher in advance assuming a change (reduction) in the circumferential speed due to the abrasion of the outer diameter of the rubber roller. Also, the drive mechanism 50 makes the circumferential speed of the rubber roller follow the circumferential speed of the metal roller. With this configuration, the drive mechanism 50 can maintain constant circumferential speeds of the metal roller and the rubber roller without being affected by a change in the outer diameter of the rubber roller (a reason for setting the circumferential speed of the rubber roller to be higher will be described later).

In this embodiment, for example, it is assumed that the amount of abrasion of the outer diameter of the driven roller 38 per an assumed number of passing sheets in the color printer 1 is about 1%, and a difference of about 2.5% in the roller circumferential speed including a margin is set for the driving roller 40 and the driven roller 38. It is assumed that the driving roller 40 and the driven roller 38 are identical in the outer diameter with each other and is assumed that the rotational number of the driving roller 40 is 1 to rotate the driving roller 40 at the first circumferential speed, the driven roller 38 requires the rotational number about 1.025 times as high as the rotational number of the driving roller 40 to rotate the driven roller 38 at the second circumferential speed.

For that reason, in the drive mechanism 50, if the driving roller 40 and the driven roller 38 are identical in the outer diameter with each other, a gear ratio of the first gear 52 and the second gear 53 is set to about 1.025:1 (for example, the number of teeth in the first gear to the number of teeth in the second gear=40:39).

In the drive mechanism 50, the first gear 52 is attached to a driving shaft 40*a* of the driving roller 40. The motor 51 rotates the driving roller 40, for example, at a circumferential speed of 200 mm/sec, through the first gear 52. In the drive mechanism 50, the second gear 53 is attached to a driven shaft 38*a* of the driven roller 38, for example, through a torque limiter 56 of a hysteresis type.

The torque limiter 56 includes an outer ring 56*a* that is connected to the second gear 53 and has a first magnet 57 on an inner periphery thereof, and an inner ring 56*b* that is connected to the driven shaft 38*a* and has a second magnet 58 on an outer periphery thereof. In the torque limiter 56, the outer ring 56*a* and the inner ring 56*b* are rotatable, separately, in a state where the outer ring 56*a* and the inner ring 56*b* are fitted to each other.

A torque of the torque limiter 56 is set to be smaller than a frictional force exerted on the driven roller 38 from the sheet P and a frictional force exerted on the driven roller 38 from the driving roller 40 when the sheet P is nipped and transported by the driving roller 40 and the driven roller 38. The torque limiter 56 is not limited to the hysteresis type. The torque limiter 56 may be of a spring type or a powder type, for example.

Figure 4:
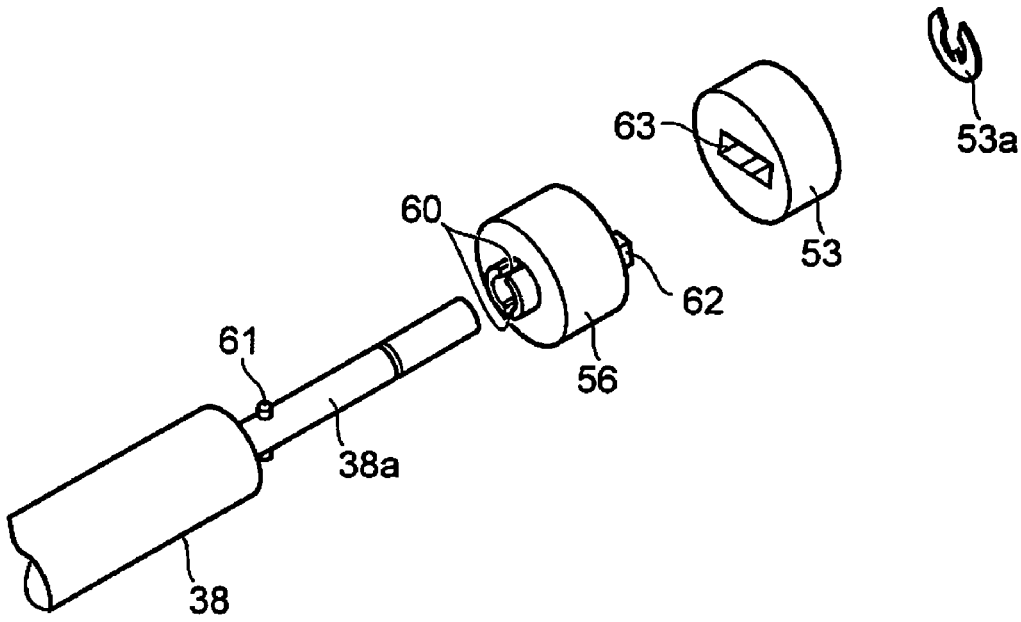
FIG. 4 is an exploded perspective view illustrating a driving side of a driven roller according to the first embodiment.

As illustrated in FIG. 4, pins 61 fixed to the driven shaft 38*a* are fitted into notches 60 of the inner ring 56*b* in the torque limiter 56, and a boss 62 of the outer ring 56*a* is fitted into a slit 63 of the second gear 53. The second gear 53 is attached to the driven shaft 38*a* through a retaining ring 53*a*. The outer ring 56*a* of the torque limiter 56 rotates same as a rotation of the second gear 53. The inner ring 56*b* of the torque limiter 56 rotates same as a rotation of the driven roller 38.

In the registration roller pair 37, if a load exerted on the torque limiter 56 at the time of nipping and transporting the sheet P is larger than a set torque of the torque limiter 56, the outer ring 56*a* and the inner ring 56*b* of the torque limiter 56 slip on each other. Accordingly, when the driven roller 38 is not abraded, even if the outer ring 56*a* of the torque limiter 56 rotates so that the circumferential speed of the driven roller 38 becomes about 1.025 times (205 mm/sec) as high as the circumferential speed of the driving roller 40, the torque limiter 56 slips, and rotation of the outer ring 56*a* is not transmitted to the driven roller 38. The driven roller 38 is driven by the sheet P due to the frictional force exerted from the sheet P, and rotates at the same circumferential speed 200 mm/sec as the circumferential speed of the driving roller 40.

As the driven roller 38 is abraded and smaller in the outer diameter, a slip speed (rotating speed difference) between the outer ring 56*a* and the inner ring 56*b* inside the torque limiter 56 becomes smaller. However, an initial circumferential speed of the driven roller 38 is set with a margin for a reduction in the circumferential speed due to the amount of abrasion of the driven roller 38. Accordingly, so far as the rate of the abrasion amount of the outer diameter of the driven roller 38 does not arrive at 2.5% which is the different in the circumferential speed between the driving roller 40 and the driven roller 38, the torque limiter 56 continues to slip. The driven roller 38 follows the circumferential speed 200 mm/sec of the driving roller 40, and continues to rotate. On the other hand, even if the abrasion amount of the outer diameter of the driven roller 38 arrives at 2.5%, the torque limiter 56 stops slip. However, the driven roller 38 rotates at the circumferential speed of 200 mm/sec from a relationship between the outer diameter of the driven roller 38 and the rotating speed of the second gear 53.

When the driven roller 38 is allowed to rotate through the torque limiter 56, reasons for setting the circumferential speed of the driven roller 38 higher than the circumferential speed of the driving roller 40 are stated below.

Reason 1: When the driven roller 38 is allowed to follow the driving roller 40 through the torque limiter 56, if the circumferential speed of the driven roller 38 is set to be higher than that of the driving roller 40, a direction of a force produced by a torque exerted on the peripheral surface of the driving roller 40 by the driven roller 38 is identical with a rotating direction of the driving roller 40. Accordingly, the torque when the driven roller 38 follows the driving roller 40 does not impede the operation of rotating the driving roller 40, but assists the rotating operation. That is, the follow of the driven roller 38 reduces a load on the driving roller 40, and reduces the price of a drive motor.

Reason 2: The same is applied to a case that the sheet P is being transported by the driving roller 40 and the driven roller 38. When the circumferential speed of the driven roller 38 is set higher than that of the driving roller 40, the torque of the driven roller 38 when follows the sheet P does not impede the operation of transmitting the sheet P. The following of the driven roller 38 prevents the transport of the sheet P from being delayed and prevents transfer shift and jamming of the sheet P.

When print is conducted in the color printer 1, the registration roller pair 37 transports the sheet P to a nip between the transfer belt 12 and the secondary transfer roller 27 at the same time when the toner images on the transfer belt 12 arrive at the secondary transfer roller 27. The color printer 1 stops the registration roller pair 37, and abuts a front end of the sheet P fed from the transport roller pair 36 against the registration roller pair 37 to align the front end of the sheet P. After aligning the front end of the sheet P, the color printer 1 drives the motor 51 to rotates the first gear 52 in a direction of an arrow x and to rotates the second gear 53 engaged with the first gear 52 in a direction of an arrow y.

With rotation of the first gear 52, the driving roller 40 rotates at the circumferential speed of 200 mm/sec in the direction of the arrow x. The second gear 53 provides the rotation to the driven roller 38. The rotation will rotate the driven roller 38 at the circumferential speed 1.025 times as high as the circumferential speed 200 mm/sec.

However, while the driven roller 38 is not abraded, and the outer diameter of the driven roller 38 is substantially equal to that of the driving roller 40, the outer ring 56*a* and the inner ring 56*b* of the torque limiter 56 slip on each other, and the rotation of the second gear 53 is not transported to the driven roller 38. Regardless of the rotation of the second gear 53, the driven roller 38 is driven by the sheet P due to the frictional force exerted from the sheet P, and rotates at the same circumferential speed 200 mm/sec as that of the driving roller 40.

When the driven roller 38 is abraded and the outer diameter of the driven roller 38 gets smaller, a slip between the outer ring 56*a* and the inner ring 56*b* of the torque limiter 56 becomes small. The rotation from the second gear 53 is transmitted to the driven roller 38 through the torque limiter 56. The driven roller 38 is surely driven by the sheet P, and rotates at the same circumferential speed 200 mm/sec as that of the driving roller 40.

In the registration roller pair 37, even when the driven roller 38 is abraded, and the outer diameter of the driven roller 38 gets small, the driven roller 38 rotates at the same circumferential speed as that of the driving roller 40. Even if the driven roller 38 is abraded, the registration roller pair 37 is not subjected to transport slip at the time of transporting the sheet P, and surely transports the sheet P to a secondary transfer position.

According to the first embodiment, the abradable driven roller 38 is connected, through the torque limiter 56, with the second gear 53 that provides the rotation that will rotate the driven roller 38 at the circumferential speed 1.025 times as high as the circumferential speed 200 mm/sec. The torque of the torque limiter 56 is set to be smaller than the frictional force exerted on the driven roller 38 from the sheet P, and the frictional force exerted on the driven roller 38 from the driving roller 40, at the time of transporting the sheet P.

According to the first embodiment, when the driven roller 38 is not abraded, the torque limiter 56 slips, the rotation of the second gear 53 is not transmitted to the driven roller 38. The driven roller 38 rotates at the same circumferential speed as the circumferential speed of the driving roller 40 due to the frictional force with the sheet P or the driving roller 40. Even if the driven roller 38 is abraded, and the outer diameter of the driven roller 38 gets small, so far as the rate of the abrasion amount of the driven roller 38 does not arrive at 2.5% which is a difference of the circumferential speed from the initial setting, the torque limiter 56 continues to slip, and the driven roller 38 continues to rotate at the same circumferential speed as the circumferential speed of the driving roller 40. If the rate of the abrasion amount of the driven roller 38 arrives at 2.5% which is the difference of the circumferential speed from the initial setting of the outer diameter of the driven roller 38, the circumferential speed of the rotation of the second gear 53 coupled to the torque limiter 56 for rotating the driven roller 38 is identical with the circumferential speed of the driven roller 38. As a result, the torque limiter 56 stops slip. Accordingly, with the help of the frictional force of the driven roller 38 with the sheet P or the driving roller 40, and the rotating force from the second gear 53 from the torque limiter 56, the driven roller 38 is surely driven by the sheet P, and rotates the same circumferential speed as that of the driving roller 40. Also, the force (torque) exerted when the torque limiter 56 slips acts in a sheet transport direction and a direction of assisting the rotation of the driving roller 40. Thus, the force does not cause adverse effect such as a sheet transport delay or the transfer shift.

According to the first embodiment, even if the outer diameter of the driven roller 38 gets small, the driven roller 38 is driven by the driving roller 40 or the sheet P at the same circumferential speed as the circumferential speed of the driving roller 40. The registration roller pair 37 surely nips and transports the sheet P with the aid of the driving roller 40 and the driven roller 38 each rotating at the same circumferential speed. The registration roller pair 37 prevents the transfer shift at the transfer position and prevents the sheet P from being jammed, due to a difference in the circumferential speed between the driving roller 40 and the driven roller 38.

Second Embodiment

Subsequently, a second embodiment will be described. The second embodiment is different in structure of the drive mechanism from the above first embodiment. In the second embodiment, the same components as those described in the above first embodiment are denoted by identical symbols, and a detailed description thereof will be omitted. In the second embodiment, the first roller and the second roller are driven by different drive sources.

Figure 5:
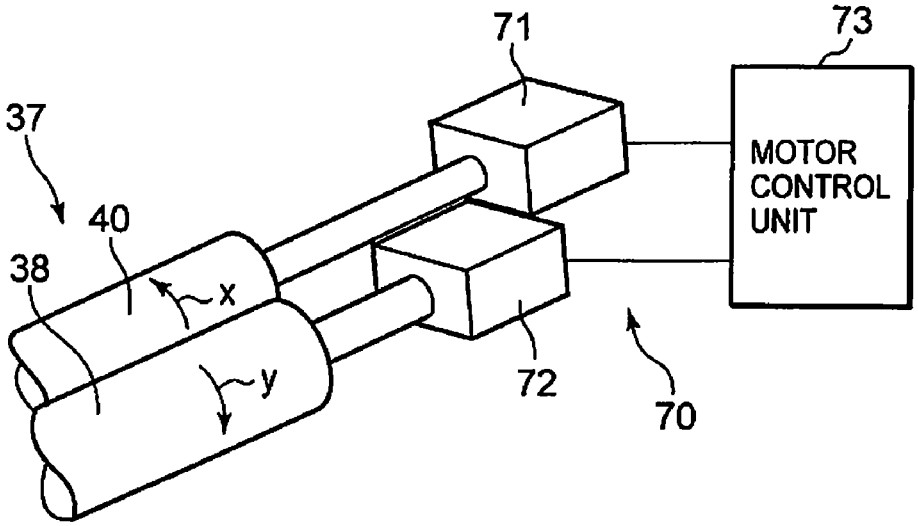
FIG. 5 is a schematic perspective view illustrating a driving side end of a registration roller pair according to a second embodiment.

In the second embodiment, as illustrated in FIG. 5, a drive mechanism 70 includes a driving roller motor 71 which is a first drive source for driving the driving roller 40 of the registration roller pair 37, a driven roller motor 72 which is a second drive source for driving the driven roller 38, and a motor controller 73 that controls the driving roller motor 71 and the driven roller motor 72. The motor controller 73 controls the driving roller motor 71 will provide a rotation to the driving roller 40 to rotate at the first circumferential speed.

Before the driven roller 38 is abraded, the motor controller 73 controls the driven roller motor 72 to rotate, for example, at 190 rpm. So that the driven roller motor 72 will provide a rotation to the driven roller 38 to rotate at the first circumferential speed same with the circumferential speed of the driving roller 40. When the driven roller 38 is abraded, and the outer diameter of the driven roller 38 gets small, the motor controller 73 controls the rotating speed of the driven roller motor 72. So that the driven roller motor 72 will provide a rotation to the driven roller 38 to rotate at the second circumferential speed higher than the first circumferential speed.

In the second embodiment, for example, it is assumed that the abrasion amount of the outer diameter of the driven roller 38 per an assumed number of passing sheets in the color printer 1 is about 1% as in the first embodiment. The motor controller 73 controls the number of rotation provide to the driven roller 38 to feedback control, with assuming the abrasion amount of the driven roller 38 according to the number of sheets passing through the registration roller pair 37. The motor controller 73 sets the number of rotation provide to the driven roller 38 to 1.01 times as high as the r number of rotation of the driving roller 40, when the assumed number of sheets pass through the registration roller pair 37 in the color printer 1 and the outer diameter of the driven roller 38 is reduced by about 1%.

When print is conducted by the color printer 1, the motor controller 73 stops the registration roller pair 37 once, and abuts the front end of the sheet P fed from the transport roller pair 36 against the registration roller pair 37 to align the front end of the sheet P. After aligning the front end of the sheet P, the motor controller 73 drives the driving roller motor 71 to rotate the driving roller 40 in the direction of the arrow x, and drives the driven roller motor 72 to rotate the driven roller 38 in the direction of the arrow y.

The motor controller 73 controls the rotation of the driving roller motor 71 at a constant rotating speed of 190 rpm, and rotates the driving roller 40 at the circumferential speed of 200 mm/sec. The motor controller 73 controls the number of rotation of the driven roller motor 72 according to the size of the outer diameter of the driven roller 38, and rotates the driven roller 38 at the same circumferential speed 200 mm/sec as the circumferential speed of the driving roller 40.

While the driven roller 38 is not abraded, and the outer diameter of the driven roller 38 is substantially equal to the outer diameter of the driving roller 40, the motor controller 73 controls the rotation of the driven roller motor 72 at the same rotating speed 190 rpm as that of the driving roller motor 71, and rotates the driven roller 38 at the same circumferential speed 200 mm/sec as the circumferential speed of the driving roller 40.

When the driven roller 38 is abraded, and the outer diameter of the driven roller 38 gets small, the motor controller 73 increases the number of rotation of the driven roller motor 72 and rotates the driven roller 38 at the same circumferential speed 200 mm/sec as the circumferential speed of the driving roller 40, assuming the size of the outer diameter decreased by the abrasion of the driven roller 38. The number of rotation of the driven roller motor 72 is set to 1.01 times of 190 rpm, which is the number of rotation of the driving roller motor 71, for example, when the outer diameter of the driven roller 38 is reduced by about 1%.

The driven roller 38 rotates at the same circumferential speed as the circumferential speed of the driving roller 40 even when the outer diameter of the driven roller 38 becomes small, and no transport slip occurs at the time of transporting the sheet P. Regardless of the abrasion of the driven roller 38, the registration roller pair 37 surely transports the sheet P to the secondary transfer position without any transport delay of the sheet P.

According to the second embodiment, the driving roller 40 is rotated by the driving roller motor 71, and the driven roller 38 is rotated by the driven roller motor 72. The motor controller 73 controls the number or rotation of the driven roller motor 72 according to the size of the outer diameter of the driven roller 38.

According to the second embodiment, even if the outer diameter of the driven roller 38 gets small, the driven roller 38 is driven by the driving roller 40 or the sheet P at the same circumferential speed as the circumferential speed of the driving roller 40. The registration roller pair 37 nips and transports the sheet P with the aid of the driving roller 40 and the driven roller 38 each rotating at the same circumferential speed. The registration roller pair 37 prevents the transfer shift at the transfer position and prevent the sheet P from being jammed, due to a difference in the circumferential speed between the driving roller 40 and the driven roller 38.

According to at least one of the above embodiments, even if the second roller lower in abrasion resistance is abraded, the second roller is driven by the first roller at the same circumferential speed as the circumferential speed of the first roller. The registration roller pair surely nips and transports the recording medium with the aid of the first roller and the second roller each rotating at the same circumferential speed.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and their equivalents are intended to cover such forms of modifications as would fall within the scope and spirit of the invention.

What is claimed is:

1. A sheet transport device comprising:

a registration roller pair that includes a first roller and a second roller lower in abrasion resistance than the first roller, and nips and transports a recording medium; and a drive mechanism that provides a rotation to the first roller to rotate at the first circumferential speed, and provides a rotation to the second roller to rotate at the second circumferential speed different from the first circumferential speed.

2. The device according to claim 1, further comprising the second circumferential speed by the drive mechanism is higher than the first circumferential speed by the drive mechanism.

3. The device according to claim 2, further comprising: a torque limiter located between the second roller and the drive mechanism.

4. The device according to claim 3, further comprising a torque of the torque limiter is smaller than a frictional force of the second roller with the recording medium at the time of transporting the recording medium.

5. The device according to claim 4, wherein the second roller is driven by the recording medium and rotates at the first circumferential speed at the time of transporting the recording medium.

6. The device according to claim 1, wherein the drive mechanism includes a first gear that provides the rotation to the first roller to rotate at the first circumferential speed and a second gear that is engaged with the first gear and provides the rotation to the second roller to rotate at the second circumferential speed.

7. The device according to claim 6, wherein the first roller and the second roller are identical in size of an outer diameter at an initial time with each other, and the number of teeth in the first gear is more than the number of teeth in the second gear.

8. The device according to claim 1, wherein the first roller is a metal roller, and the second roller is a rubber roller.

9. An image forming apparatus, comprising:

an image formation unit that forms a toner image on an image carrier;

a registration roller pair that includes a first roller and a second roller lower in abrasion resistance than the first roller, and nips and transports a recording medium to a transfer position of the toner image on the image carrier; and a drive mechanism that provides a rotation to the first roller to rotate at the first circumferential speed, and provides a rotation to the second roller to rotate at the second circumferential speed different from the first circumferential speed.

10. The apparatus according to claim 9, further comprising the second circumferential speed by the drive mechanism is higher than the first circumferential speed by the drive mechanism.

11. The apparatus according to claim 10, further comprising: a torque limiter located between the second roller and the drive mechanism.

12. The apparatus according to claim 11, further comprising a torque of the torque limiter is smaller than a frictional force of the second roller with the recording medium at the time of transporting the recording medium.

13. The apparatus according to claim 12, wherein the second roller is driven by the recording medium and rotates at the first circumferential speed at the time of transporting the recording medium.

14. The apparatus according to claim 9, wherein the drive mechanism includes a first gear that provides the rotation to the first roller to rotate at the first circumferential speed and a second gear that is engaged with the first gear and provides the rotation to the second roller to rotate at the second circumferential speed.

15. The apparatus according to claim 14, wherein the first roller and the second roller are identical in size of an outer diameter at an initial time with each other, and the number of teeth in the first gear is more than the number of teeth in the second gear.

16. The apparatus according to claim 9, wherein the first roller is a metal roller, and the second roller is a rubber roller.

17. A sheet transporting method, comprising:

abutting a recording medium against a registration roller pair and stopping the recording medium; and transporting the stopped recording medium by providing a rotation to a first roller of the registration roller pair to rotate at the first circumferential speed and providing a rotation to the second roller of the registration roller pair, which is lower in abrasion resistance than the first roller, to rotate at the second circumferential speed different from the first circumferential speed.

18. The method according to claim 17, further comprising the second circumferential speed is higher than the first circumferential speed.

19. The method according to claim 18, wherein the second roller is driven by the recording medium and rotates at the first circumferential speed at the time of transporting the recording medium.

* * * * *